US011008879B2

(12) United States Patent
Pratt et al.

(10) Patent No.: US 11,008,879 B2
(45) Date of Patent: May 18, 2021

(54) CONTINUOUS WEDGE VANE ARM WITH FAILSAFE RETENTION CLIP

(71) Applicant: United Technologies Corporation, Farmington, CT (US)

(72) Inventors: William S. Pratt, West Hartford, CT (US); Matthew E. Bintz, West Hartford, CT (US); Steven D. Roberts, Moodus, CT (US); Adam Hart, East Hampton, CT (US)

(73) Assignee: RAYTHEON TECHNOLOGIES CORPORATION, Farmington, CT (US)

( * ) Notice: Subject to any disclaimer, the term of this patent is extended or adjusted under 35 U.S.C. 154(b) by 98 days.

(21) Appl. No.: 16/251,674

(22) Filed: Jan. 18, 2019

(65) Prior Publication Data

US 2020/0232336 A1 Jul. 23, 2020

(51) Int. Cl.

| | |
|---|---|
| ***F01D 9/04*** | (2006.01) |
| ***F01D 17/16*** | (2006.01) |
| ***F01D 17/12*** | (2006.01) |
| ***F04D 29/52*** | (2006.01) |

(52) U.S. Cl.

CPC ..... *F01D 9/042* (2013.01); *F01D 17/12* (2013.01); *F01D 17/162* (2013.01); *F04D 29/524* (2013.01); *F05D 2230/644* (2013.01); *F05D 2250/90* (2013.01); *F05D 2260/31* (2013.01); *F05D 2260/941* (2013.01)

(58) Field of Classification Search

CPC ..... F01D 9/042; F01D 17/12; F05D 2250/90; F04D 29/524; F04D 29/563

See application file for complete search history.

(56) References Cited

U.S. PATENT DOCUMENTS

| | | | | |
|---|---|---|---|---|
| 4,979,874 | A | 12/1990 | Myers | |
| 5,024,580 | A | 6/1991 | Olive | |
| 6,019,574 | A * | 2/2000 | DiBella | F01D 17/162 415/148 |
| 6,799,945 | B2 * | 10/2004 | Chatel | F01D 17/162 415/156 |
| 7,278,819 | B2 * | 10/2007 | Schilling | F01D 17/162 415/147 |
| 7,344,355 | B2 | 3/2008 | Wilshaw | |

(Continued)

FOREIGN PATENT DOCUMENTS

FR 2897120 A1 8/2007

OTHER PUBLICATIONS

European Search Report for Application No. 19209583.4 filed on Nov. 15, 2019; dated Jul. 8, 2020; 30 pages.

*Primary Examiner* — J. Todd Newton
*Assistant Examiner* — Andrew J Marien
(74) *Attorney, Agent, or Firm* — Cantor Colburn LLP

(57) ABSTRACT

A vane arm assembly for a gas turbine engine is provided including: a vane arm having a first end, a second end opposite the first end, and an aperture proximate the second end, the aperture being defined by an aperture wall; a vane stem extending through the aperture of the vane arm; a mechanical fastener retaining a position of the vane arm in the longitudinal direction of the vane stem; and an impedance clip partially enclosing a portion of the second end of the vane arm to provide redundant position retention of the vane arm in the longitudinal direction of the vane stem.

14 Claims, 6 Drawing Sheets

(56) References Cited

U.S. PATENT DOCUMENTS

| | | | | |
|---|---|---|---|---|
| 8,864,450 | B2 * | 10/2014 | Gasmen | F01D 17/162 415/160 |
| 9,988,926 | B2 * | 6/2018 | Gasmen | F01D 17/162 |
| 10,030,533 | B2 * | 7/2018 | Dougan | F01D 17/162 |
| 10,590,795 | B2 * | 3/2020 | Pratt | F02C 9/20 |
| 2003/0147743 | A1 | 8/2003 | Chatel et al. | |
| 2016/0201499 | A1 * | 7/2016 | Pudvah | F16B 21/16 415/148 |

* cited by examiner

CONTINUOUS WEDGE VANE ARM WITH FAILSAFE RETENTION CLIP

STATEMENT OF FEDERAL SUPPORT

This invention was made with Government support awarded by the United States. The Government has certain rights in the invention.

BACKGROUND

The subject matter disclosed herein generally relates to gas turbine engines and, more particularly, to a self-retaining vane arm assembly for gas turbine engines.

Turbine engines include a plurality of engine sections such as, for example, a fan section, a compressor section, a combustor section and a turbine section. Some turbine engines may also include a variable area vane arrangement. Such a vane arrangement may be configured to guide and/or adjust the flow of gas into a respective one of the engine sections. Alternatively, the vane arrangement may be configured to guide and/or adjust the flow of gas between adjacent stages of a respective one of the engine sections.

Some variable area vane arrangements include a plurality of adjustable stator vanes that are rotatably connected to an inner vane platform and an outer vane platform. Each of the stator vanes includes an airfoil that extends between the inner and the outer vane platforms. Each of the stator vanes may be rotated about a respective axis using a vane arm. A vane arm may be a sheet metal or machined piece that transmits load from a synchronizing ring to a variable vane stem. The end of the vane arm that interfaces with the synchronizing ring has a pin swaged into a hole on the end, and sits in a pinhole on the ring. The end of the vane arm that attaches to the vane stem are secured to the vane stem typically by a single retention method. However, additional retention methods are desired for redundancy. Further, prior art designs have had difficulty in meeting more stringent stress requirements due to increased torque experienced by the vane stems in recent years.

SUMMARY

According to an embodiment, a vane arm assembly for a gas turbine engine is provided. The vane arm assembly including: a vane arm having a first end, a second end opposite the first end, and an aperture proximate the second end, the aperture being defined by an aperture wall; a vane stem extending through the aperture of the vane arm; a mechanical fastener retaining a position of the vane arm in the longitudinal direction of the vane stem; and an impedance clip partially enclosing a portion of the second end of the vane arm to provide redundant position retention of the vane arm in the longitudinal direction of the vane stem.

In addition to one or more of the features described above, or as an alternative, further embodiments may include that the impedance clip includes one or more tabs at least partially disposed within the aperture of the vane arm.

In addition to one or more of the features described above, or as an alternative, further embodiments may include that the impedance clip is interposed between the mechanical fastener and the vane arm.

In addition to one or more of the features described above, or as an alternative, further embodiments may include: an angled face disposed on an exterior of the vane stem; and a wedge face disposed on the aperture wall, the wedge face and the angled face having a corresponding geometry, the wedge face and the angled face in contact with each other in a preloaded condition to transmit torque from the vane arm to the vane stem.

In addition to one or more of the features described above, or as an alternative, further embodiments may include: an anti-rotation wall disposed on the exterior of the vane stem, the anti-rotation wall angularly offset from the angled face of the vane stem; and an anti-rotation surface disposed on the aperture wall and angularly offset from the wedge face of the vane arm, the anti-rotation wall and the anti-rotation surface having a corresponding geometry, the anti-rotation wall and the anti-rotation surface in contact with each other to maintain torque transmission from the vane arm to the vane stem during a surge condition.

In addition to one or more of the features described above, or as an alternative, further embodiments may include that the anti-rotation wall is disposed radially outwardly of the angled face.

In addition to one or more of the features described above, or as an alternative, further embodiments may include that the anti-rotation surface is disposed radially outwardly of the wedge face.

In addition to one or more of the features described above, or as an alternative, further embodiments may include that the vane arm is operatively coupled to an actuator ring with a pin proximate to a first end of the vane arm, the vane arm operatively coupled to the vane stem proximate a second end of the vane arm to actuate movement of at least one adjustable guide vane in the gas turbine engine.

According another embodiment, a gas turbine engine is provided. The gas turbine engine including: a compressor section; a combustor section; a turbine section; and a vane arm assembly operatively coupled to an actuator ring and to at least one adjustable guide vane in the compressor section, the vane arm assembly including: a vane arm having a first end, a second end opposite the first end, and an aperture proximate the second end, the aperture being defined by an aperture wall; a vane stem extending through the aperture of the vane arm; a mechanical fastener retaining a position of the vane arm in the longitudinal direction of the vane stem; and an impedance clip partially enclosing a portion of the second end of the vane arm to provide redundant position retention of the vane arm in the longitudinal direction of the vane stem.

In addition to one or more of the features described above, or as an alternative, further embodiments may include that the impedance clip includes one or more tabs at least partially disposed within the aperture of the vane arm.

In addition to one or more of the features described above, or as an alternative, further embodiments may include that the impedance clip is interposed between the mechanical fastener and the vane arm.

In addition to one or more of the features described above, or as an alternative, further embodiments may include that the vane arm assembly further includes: an angled face disposed on an exterior of the vane stem; and a wedge face disposed on the aperture wall, the wedge face and the angled face having a corresponding geometry, the wedge face and the angled face in contact with each other in a preloaded condition to transmit torque from the vane arm to the vane stem.

In addition to one or more of the features described above, or as an alternative, further embodiments may include: an anti-rotation wall disposed on the exterior of the vane stem, the anti-rotation wall angularly offset from the angled face of the vane stem; and an anti-rotation surface disposed on the aperture wall and angularly offset from the wedge face of the vane arm, the anti-rotation wall and the anti-rotation surface having a corresponding geometry, the anti-rotation wall and the anti-rotation surface in contact with each other to maintain torque transmission from the vane arm to the vane stem during a surge condition.

In addition to one or more of the features described above, or as an alternative, further embodiments may include that the anti-rotation wall is disposed radially outwardly of the angled face.

In addition to one or more of the features described above, or as an alternative, further embodiments may include that the anti-rotation surface is disposed radially outwardly of the wedge face.

In addition to one or more of the features described above, or as an alternative, further embodiments may include that the vane arm is operatively coupled to an actuator ring with a pin proximate to a first end of the vane arm, the vane arm operatively coupled to the vane stem proximate a second end of the vane arm to actuate movement of at least one adjustable guide vane in the gas turbine engine.

The foregoing features and elements may be combined in various combinations without exclusivity, unless expressly indicated otherwise. These features and elements as well as the operation thereof will become more apparent in light of the following description and the accompanying drawings. It should be understood, however, that the following description and drawings are intended to be illustrative and explanatory in nature and non-limiting.

BRIEF DESCRIPTION

The following descriptions should not be considered limiting in any way. With reference to the accompanying drawings, like elements are numbered alike:

The detailed description explains embodiments of the present disclosure, together with advantages and features, by way of example with reference to the drawings.

DETAILED DESCRIPTION

A detailed description of one or more embodiments of the disclosed apparatus and method are presented herein by way of exemplification and not limitation with reference to the Figures.

Figure 1:
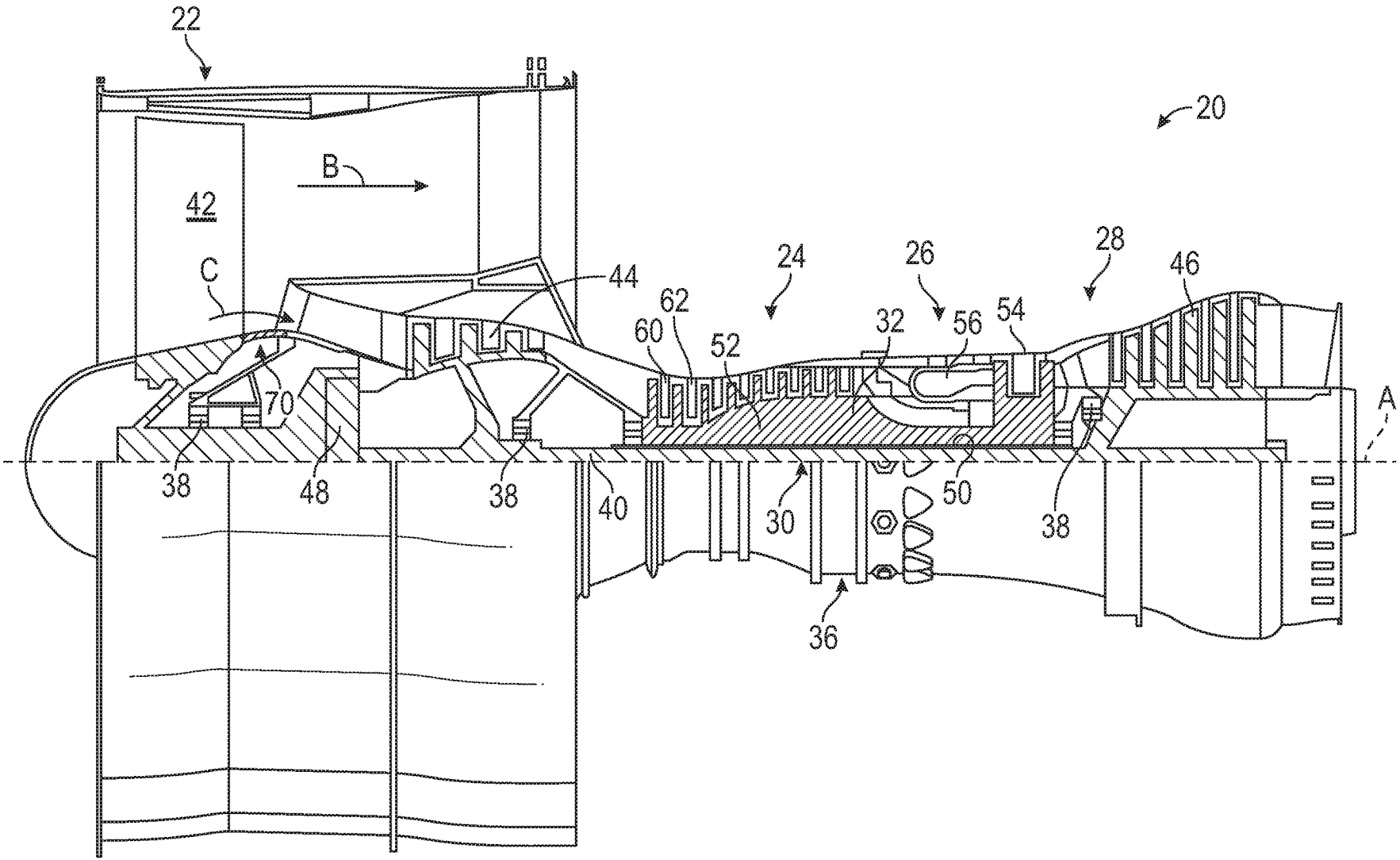
FIG. 1 is a partial cross-sectional illustration of a gas turbine engine, in accordance with an embodiment of the disclosure.

FIG. 1 schematically illustrates a gas turbine engine 20. The gas turbine engine 20 is disclosed herein as a two-spool turbofan that generally incorporates a fan section 22, a compressor section 24, a combustor section 26 and a turbine section 28. Alternative engines might include an augmentor section (not shown) among other systems or features. The fan section 22 drives air along a bypass flow path B in a bypass duct, while the compressor section 24 drives air along a core flow path C for compression and communication into the combustor section 26 then expansion through the turbine section 28. Although depicted as a two-spool turbofan gas turbine engine in the disclosed non-limiting embodiment, it should be understood that the concepts described herein are not limited to use with two-spool turbofans as the teachings may be applied to other types of turbine engines including three-spool architectures.

The exemplary engine 20 generally includes a low speed spool 30 and a high speed spool 32 mounted for rotation about an engine central longitudinal axis A relative to an engine static structure 36 via several bearing systems 38. It should be understood that various bearing systems 38 at various locations may alternatively or additionally be provided, and the location of bearing systems 38 may be varied as appropriate to the application.

The low speed spool 30 generally includes an inner shaft 40 that interconnects a fan 42, a low pressure compressor 44 and a low pressure turbine 46. The inner shaft 40 is connected to the fan 42 through a speed change mechanism, which in exemplary gas turbine engine 20 is illustrated as a geared architecture 48 to drive the fan 42 at a lower speed than the low speed spool 30. The high speed spool 32 includes an outer shaft 50 that interconnects a high pressure compressor 52 and high pressure turbine 54. A combustor 56 is arranged in exemplary gas turbine 20 between the high pressure compressor 52 and the high pressure turbine 54. An engine static structure 36 is arranged generally between the high pressure turbine 54 and the low pressure turbine 46. The engine static structure 36 further supports bearing systems 38 in the turbine section 28. The inner shaft 40 and the outer shaft 50 are concentric and rotate via bearing systems 38 about the engine central longitudinal axis A which is collinear with their longitudinal axes.

The core airflow is compressed by the low pressure compressor 44 then the high pressure compressor 52, mixed and burned with fuel in the combustor 56, then expanded over the high pressure turbine 54 and low pressure turbine 46. The turbines 46, 54 rotationally drive the respective low speed spool 30 and high speed spool 32 in response to the expansion. It will be appreciated that each of the positions of the fan section 22, compressor section 24, combustor section 26, turbine section 28, and fan drive gear system 48 may be varied. For example, gear system 48 may be located aft of combustor section 26 or even aft of turbine section 28, and fan section 22 may be positioned forward or aft of the location of gear system 48.

The engine 20 in one example is a high-bypass geared aircraft engine. In a further example, the engine 20 bypass ratio is greater than about six (6), with an example embodiment being greater than about ten (10), the geared architecture 48 is an epicyclic gear train, such as a planetary gear system or other gear system, with a gear reduction ratio of greater than about 2.3 and the low pressure turbine 46 has a pressure ratio that is greater than about five. In one disclosed embodiment, the engine 20 bypass ratio is greater than about ten (10:1), the fan diameter is significantly larger than that of the low pressure compressor 44, and the low pressure turbine 46 has a pressure ratio that is greater than about five 5:1. Low pressure turbine 46 pressure ratio is pressure measured prior to inlet of low pressure turbine 46 as related to the pressure at the outlet of the low pressure turbine 46 prior to an exhaust nozzle. The geared architecture 48 may be an epicycle gear train, such as a planetary gear system or other gear system, with a gear reduction ratio of greater than about 2.3:1. It should be understood, however, that the above parameters are only exemplary of one embodiment of a geared architecture engine and that the present disclosure is applicable to other gas turbine engines including direct drive turbofans.

A significant amount of thrust is provided by the bypass flow B due to the high bypass ratio. The fan section 22 of the engine 20 is designed for a particular flight condition—typically cruise at about 0.8 Mach and about 35,000 feet (10,688 meters). The flight condition of 0.8 Mach and 35,000 ft (10,688 meters), with the engine at its best fuel consumption—also known as "bucket cruise Thrust Specific Fuel Consumption ('TSFC')"—is the industry standard parameter of lbm of fuel being burned divided by lbf of thrust the engine produces at that minimum point. "Low fan pressure ratio" is the pressure ratio across the fan blade alone, without a Fan Exit Guide Vane ("FEGV") system. The low fan pressure ratio as disclosed herein according to one non-limiting embodiment is less than about 1.45. "Low corrected fan tip speed" is the actual fan tip speed in ft/sec divided by an industry standard temperature correction of $[(\text{Tram}\ ^\circ\ \text{R})/(518.7^\circ\ \text{R})]^{0.5}$. The "Low corrected fan tip speed" as disclosed herein according to one non-limiting embodiment is less than about 1150 ft/second (350.5 m/sec).

With continued reference to FIG. 1, the engine 20 also includes one or more variable area vane arrangements; e.g., vane arrangements 60, 62, etc. The vane arrangements directs gas for a respective engine section. In the illustrated example, the vane arrangement 60 guides and/or adjusts the flow of the core air into the compressor section 24. The vane arrangement 62 guides and/or adjusts the flow of the core air through the compressor section 24; e.g., between adjacent compressor rotor stages.

Figure 2:
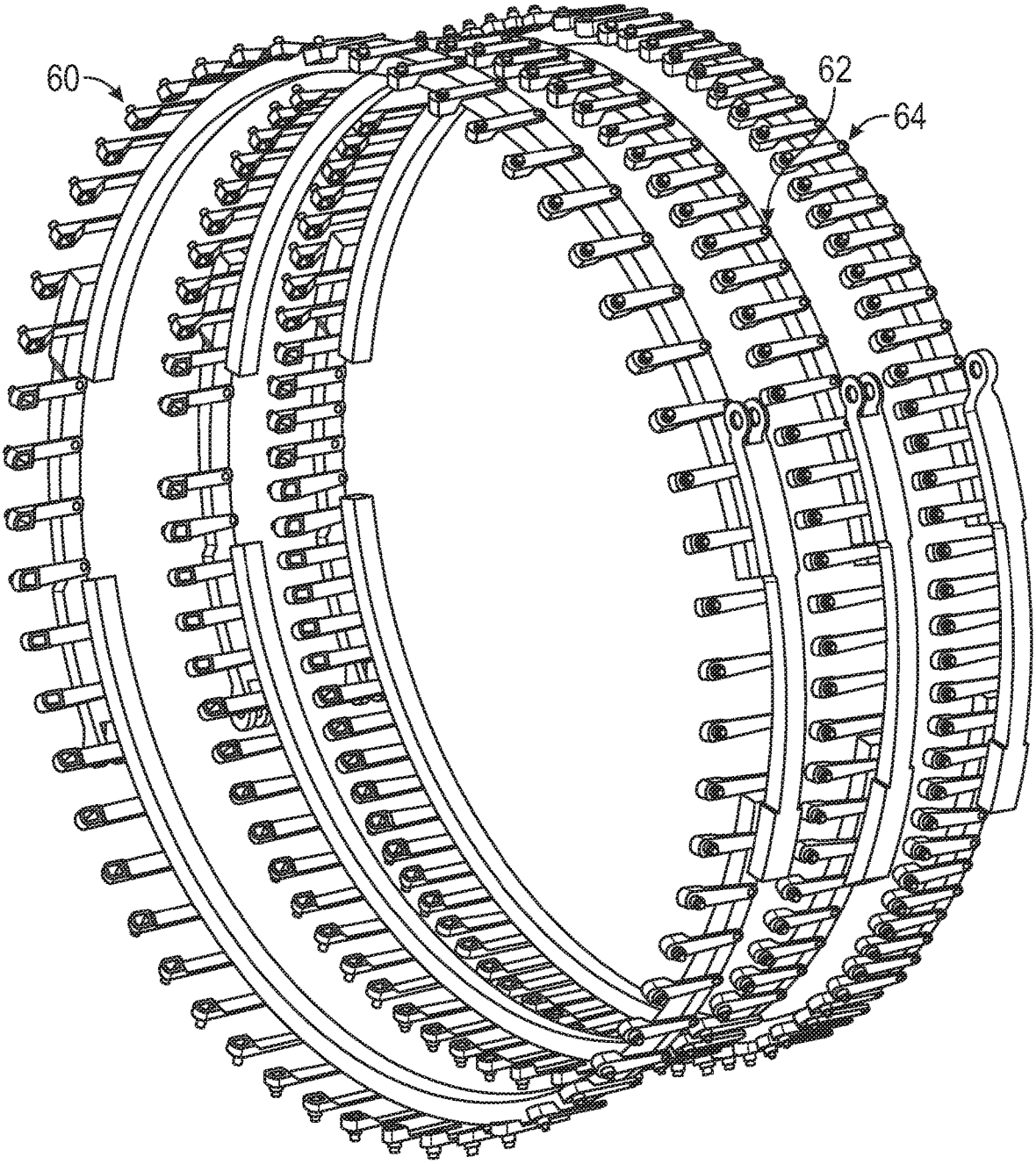
FIG. 2 is a perspective view of a plurality of variable vane stages of the gas turbine engine, in accordance with an embodiment of the disclosure.

Referring now to FIG. 2, three vane arrangements 60, 62, 64 are illustrated, in accordance with an embodiment of the present disclosure. The number of arrangements may vary depending upon the particular application. Regardless of the number of vane arrangements, each arrangement includes one or more adjustable stator vanes that are arranged circumferentially around the central axis. Each of the stator vanes may be rotated about its respective axis by pivoting a respective vane arm assembly 100 with an actuator (not shown).

Figure 3:
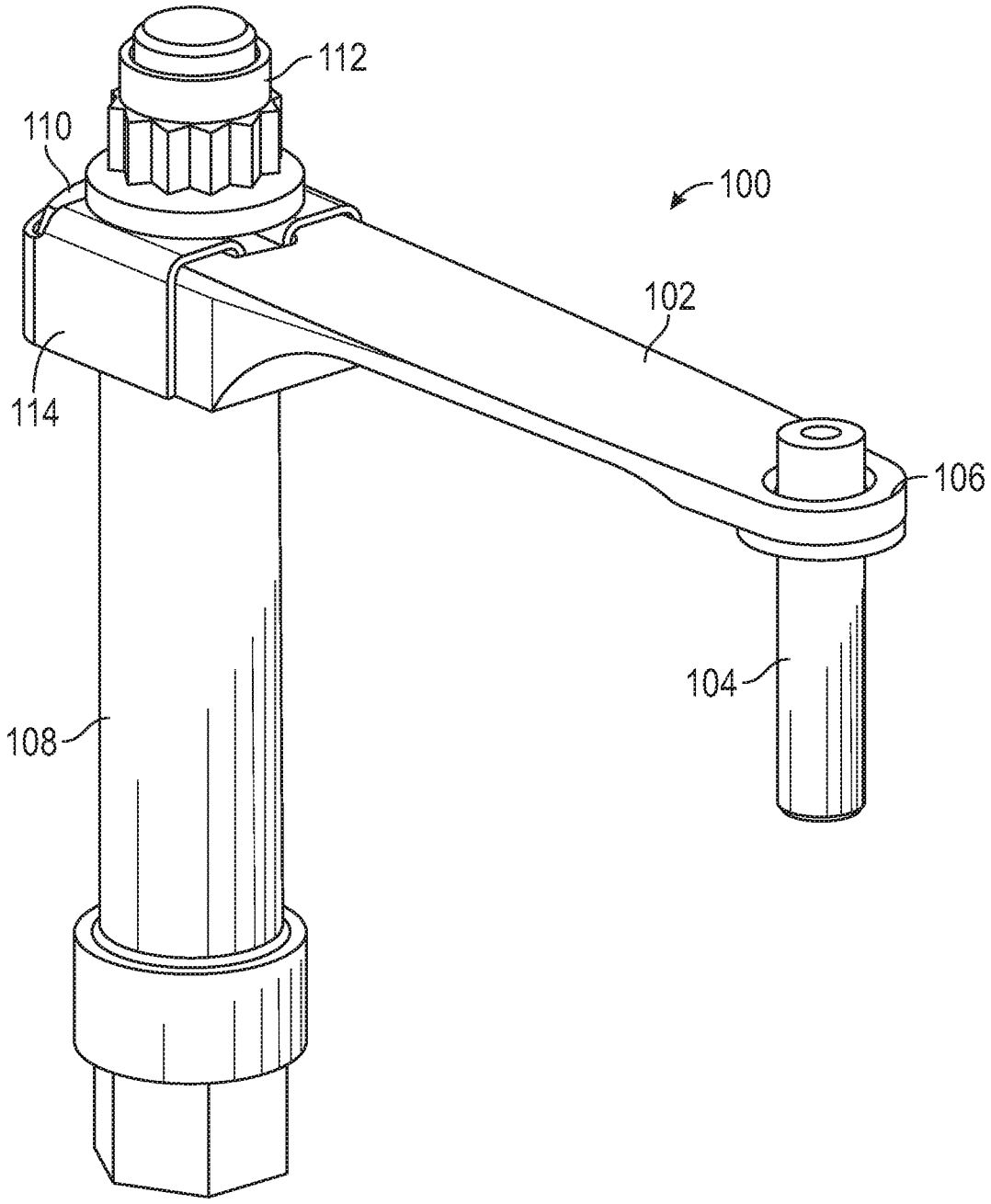
FIG. 3 is perspective view of a vane arm assembly in an assembled condition, in accordance with an embodiment of the disclosure.
Figure 4:
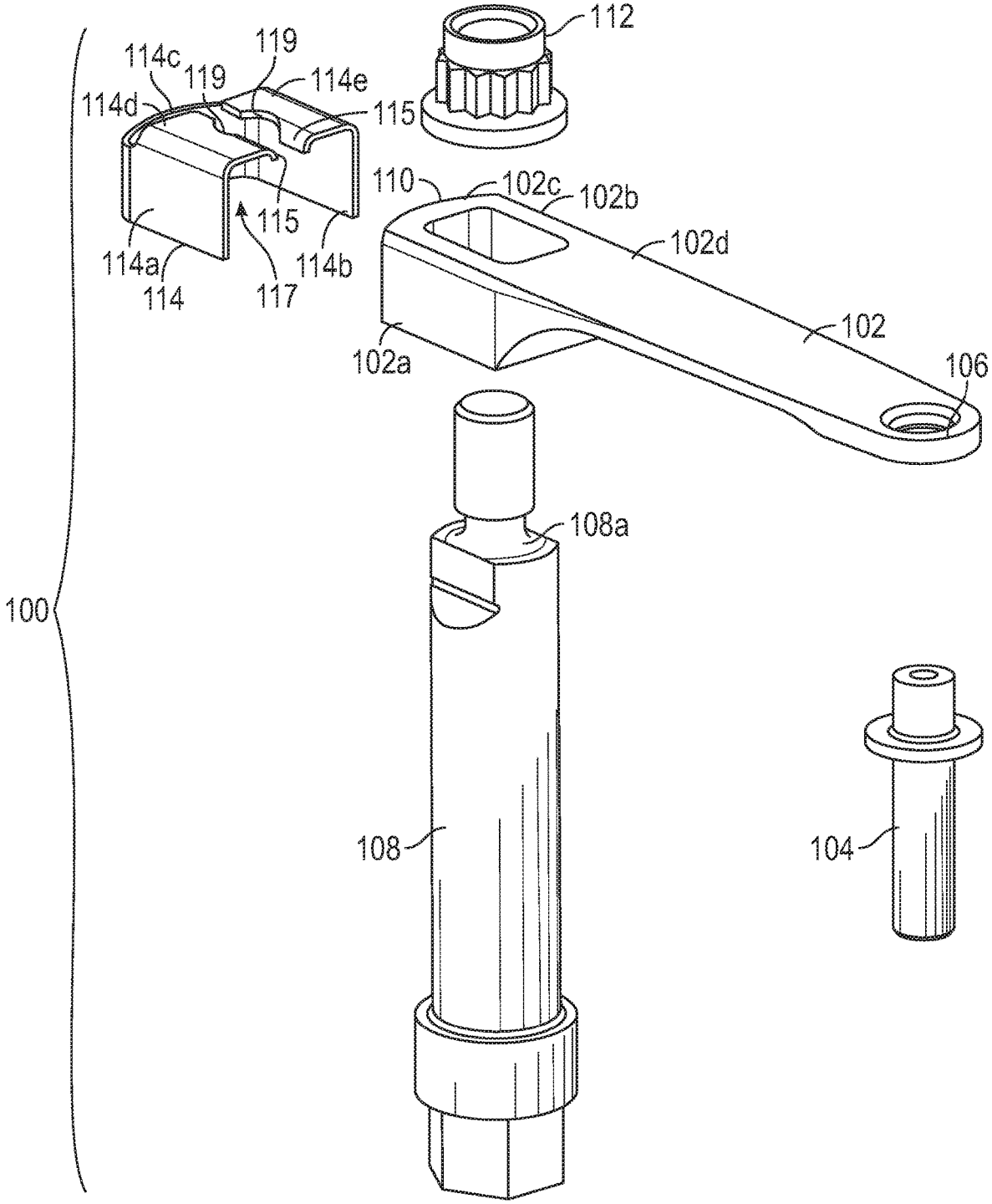
FIG. 4 is a perspective view of the vane arm assembly in a disassembled condition, in accordance with an embodiment of the disclosure.
Figure 5:
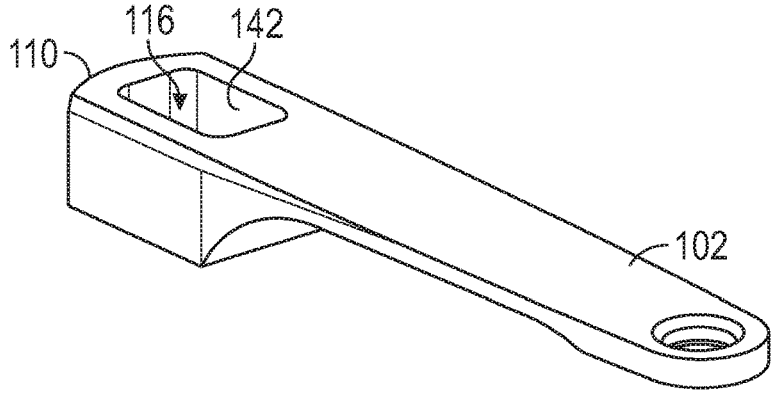
FIG. 5 is a perspective view of a vane arm of the vane arm assembly, in accordance with an embodiment of the disclosure.

Referring to FIGS. 3 and 4, the vane arm assembly 100 is illustrated in greater detail, with FIG. 3 depicting an assembled condition of the vane arm assembly 100 and FIG. 4 showing the assembly in a disassembled condition, in accordance with an embodiment of the present disclosure. The vane arm assembly 100 includes a vane arm 102. The vane arm 102 is operatively coupled to the actuator with a pin 104 proximate a first end 106 of the vane arm 102. The vane arm 102 is coupled to a vane stem 108 proximate a second end 110 of the vane arm 102. Coupling of the vane arm 102 to the vane stem 108 is made with corresponding geometry of the vane stem 108 and interior portions of the vane arm 102, as well as a mechanical fastener 112 and an impedance clip 114, as described in detail herein. In an embodiment, the mechanical fastener 112 may be a lock nut. As will be appreciated from the description herein, the three forms of retention provided by a preload by the mechanical fastener 112, the mechanical fastener 112 and the impedance clip 114 ensure layers of retention redundancy and can withstand significant surge loading that may occur. Advantageously, the additionally layers of retention redundancy provided by the addition of the impedance clip 114 helps meet more stringent stress requirements due to increased torque experienced by the vane stems in recent years. Additionally, the vane arm assembly 100 disclosed herein allows for a more reliable and efficient assembly process.

The impedance clip 114 is located proximate the second end 110 of the vane arm 102. The impedance clip 114 partially encloses a portion of the second end 110 of the vane arm 102, as shown in FIG. 3. The impedance clip 114 includes a first side wall 114*a*, a second side wall 114*b* opposite the first side wall 114*a*, and a third side wall 114*c* connecting the first side wall 114*a* and the second side wall 114*b*. A first top wall 114*d* is attached to the first side wall 114*a*. The first top wall 114*d* is oriented (e.g., bent) about perpendicular to the first side wall 114*a*. A second top wall 114*e* is attached to the second side wall 114*b*. The second top wall 114*e* is oriented (e.g., bent) about perpendicular to the second side wall 114*b*.

The first side wall 114*a*, the second side wall 114*b*, the third side wall 114*c*, the first top wall 117*d*, and the second top wall 117*e* partially enclose a cavity 117, as shown in FIG. 4. The second end 110 of the vane arm 102 is slid into the cavity 117 during assembly of the vane arm assembly 100, such that the impedance clip 114 partially encloses a portion of the second end 110 of the vane arm 102, as shown in FIG. 3. The first top wall 114*d* and the second top wall 114*e* include a cut out 119 to wrap around a neck portion 108*a* of the vane stem 108, as shown in FIGS. 3 and 4. The impedance clip 114 may be interposed between the mechanical fastener 112 and the vane arm 102 when the vane arm assembly 100 is assembled, as shown in FIG. 3.

The first side wall 114*a* is adjacent with a first side 102*a* of the vane stem arm 102 when the vane stem assembly 100 is assembled. The first side wall 114*a* and the first side 102*a* may have corresponding geometry. The second side wall 114*b* is adjacent with a second side 102*b* of the vane stem arm 102 when the vane stem assembly 100 is assembled. The second side 102*b* is opposite the first side 102*a*. The second side wall 114*b* and the second side 102*b* may have corresponding geometry. The third side wall 114*c* is adjacent with a third side 102*c* of the vane stem arm 102 when the vane stem assembly 100 is assembled. The third side 102*c* extends between the first side 102*a* and the second side 102*b*. The third side wall 114*c* and the third side 102*c* may have corresponding geometry. The top side walls 114*d*, 114*e* are adjacent with a top side 102*d* of the vane stem arm 102 when the vane stem assembly 100 is assembled. The top side walls 114*d*, 114*e* and the top side 102*d* may have corresponding geometry.

Figure 6:
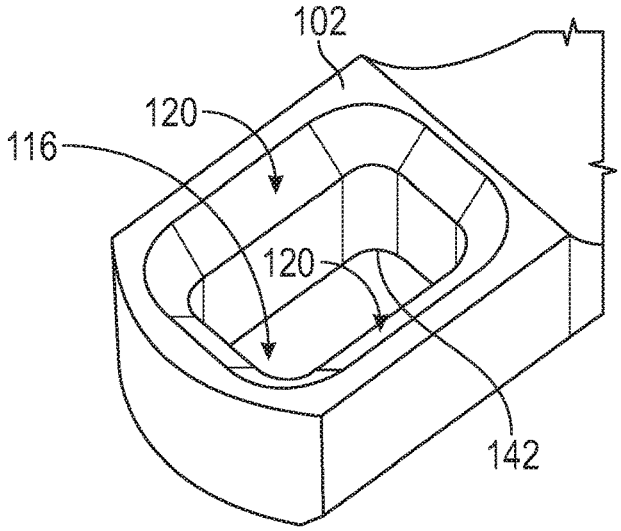
FIG. 6 is a view of an aperture of the vane arm, in accordance with an embodiment of the disclosure.
Figure 7:
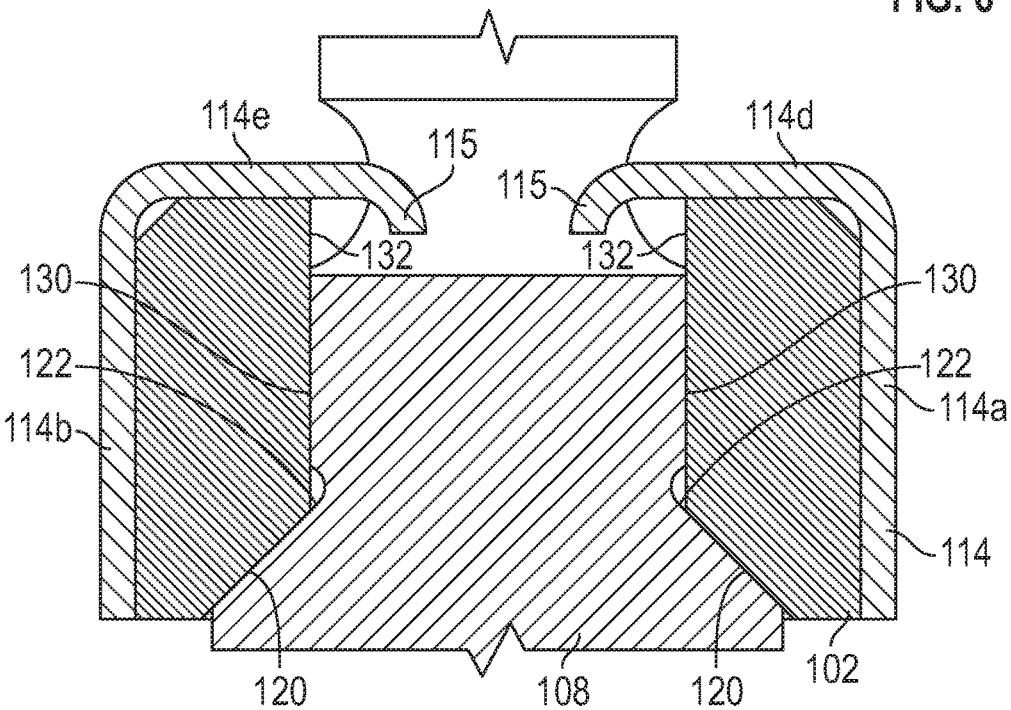
FIG. 7 is a cross-sectional view of the vane arm assembly, in accordance with an embodiment of the disclosure.
Figure 8:
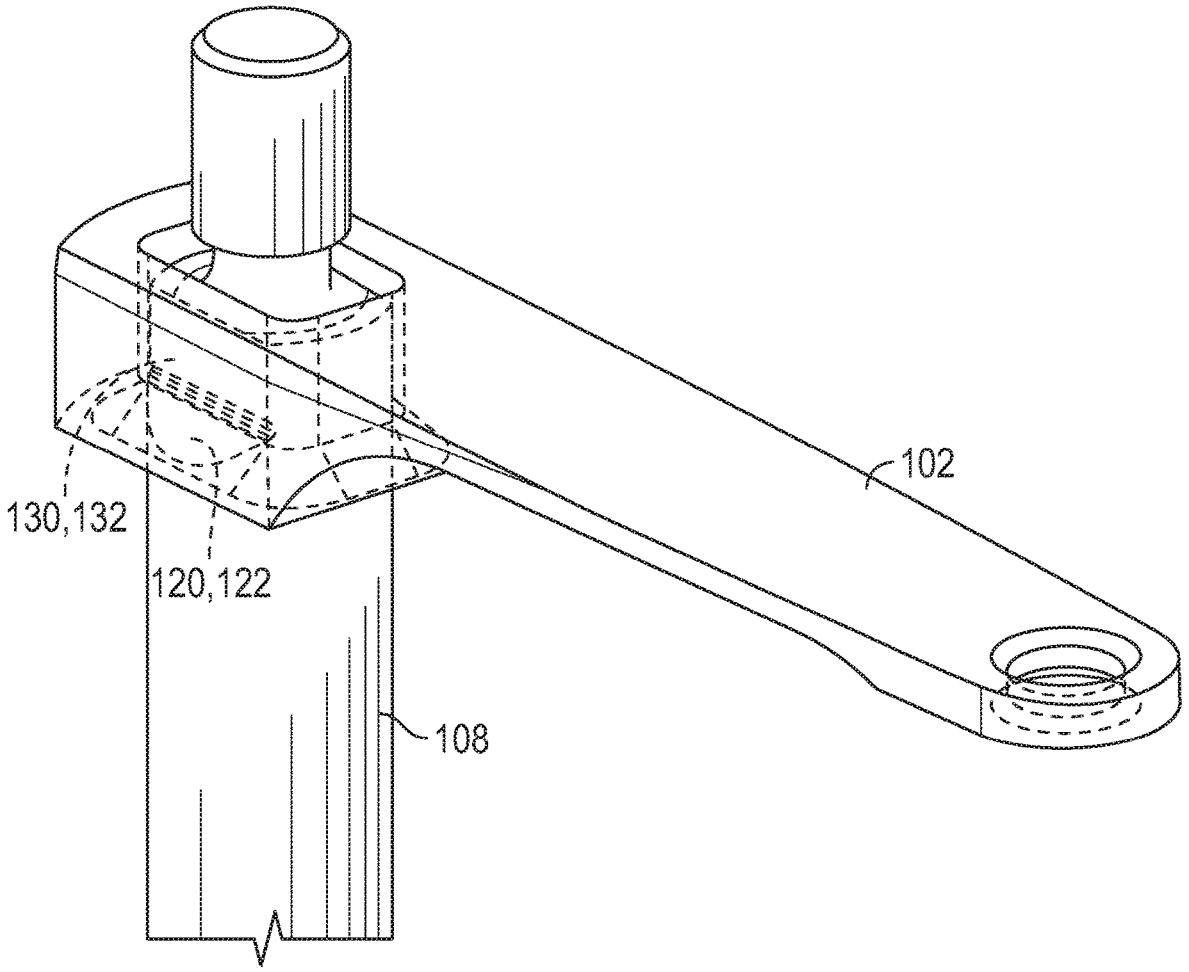
FIG. 8 is a perspective view of a portion of the vane arm assembly, in accordance with an embodiment of the disclosure.

Referring now to FIGS. 5-8, with continued reference to FIGS. 1-4, the vane arm 102 and the vane stem 108 are illustrated in greater detail, with FIGS. 6 and 7 showing the second end 110 portion of the vane arm 102 which couples to the vane stem 108, in accordance with an embodiment of the present disclosure. An aperture wall 142 within the vane arm 102 defines an aperture 116 proximate the second end 110 that receives the vane stem 108 therethrough. At a radially inner portion of the aperture wall 142 that defines the aperture 116 is an angled face, which may also be referred to as a wedge face 120.

The wedge face 120 extends around at least a portion of the aperture wall 142 and is shown well in FIG. 7, which is a cross-sectional view of the radially inner portion of the vane arm 102. In the illustrated embodiment, a pair of wedge faces 120 are disposed on opposing sides of the aperture 116. The geometry of the wedge face(s) 120 substantially corresponds to an angled face 122 of the vane stem (FIG. 7). As with the wedge face 120, the angled face 122 of the vane stem 108 in the illustrated embodiment is actually a pair of faces 122 on opposing sides of the vane stem 108. The surfaces of the faces 120, 122 are in contact in a preloaded condition upon assembly, with the substantially corresponding geometry transmitting torque from the vane arm 102 to the vane stem 108 under normal operation of the vane arm assembly 100 and the compressor section 24.

The angled face 122 of the vane stem 108 transitions into a substantially planar anti-rotation wall 130 radially outward of the angled face 122. In the illustrated embodiment, a pair of anti-rotation walls 130 are present and the walls engage corresponding anti-rotation surfaces 132 of the aperture wall 142 of the vane arm 102. Collectively, the anti-rotation walls 130 and the anti-rotation surfaces 132 may be referred to as an anti-rotation slot. The anti-rotation slot prevents the vane arm 102 from translating along the vane stem 108 during a surge event. Consequently, the anti-rotation slot resolves a surge torque after the preload on the wedge face 120 and angled face 122 is lost.

The material, geometry, and dimensions of the impedance clip 114 allows for expansion and compression of the impedance clip 114 during assembly and disassembly. The first side 114*a* and the second side 114*b* of impedance clip 114 may be flexed away from each other to slide onto the second end 110 of the vane arm 102 and wrap the top sides 104*d*, 104*e* around the neck 108 of the vane stem 108. The impedance clip 114 includes one or more tabs 115 at least partially disposed within the aperture 116 of the vane arm 102. The tabs 115 may be bent into the aperture 116 during assembly of the vane arm assembly 100. The tabs 115 of the impedance clip 114 provide retention redundancy, by restraining movement of the vane arm 102 relative to the longitudinal direction of the vane stem 108 in the event the mechanical fastener 112 is damaged or disengaged.

As shown, the vane arm 102 is able to transmit torque to the vane stem 108 via the preloaded wedge face 120 and angled face 122, with a secondary torque transmission feature provided with the anti-rotation slot, which is comprised of the anti-rotation walls 130 and the anti-rotation surfaces 132. Additionally, redundant retention features are provided in the form of the mechanical fastener 112 and the impedance clip 114. The impedance clip 114 allows radial assembly and a single vane arm can be assembled and disassembled at a time, in contrast to axially assembled assemblies.

Technical effects of embodiments of the present disclosure include securing a vane arm assembly using an impedance clip that slides onto the vane arm and wraps around the vane stem that extends through the vane arm.

The term "about" is intended to include the degree of error associated with measurement of the particular quantity based upon the equipment available at the time of filing the application. For example, "about" can include a non-limiting range of ±8% or 5%, or 2% of a given value.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

While the present disclosure has been described with reference to an exemplary embodiment or embodiments, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the claims.

What is claimed is:

1. A vane arm assembly for a gas turbine engine comprising:

a vane arm having a first end, a second end opposite the first end, and an aperture proximate the second end, the aperture being defined by an aperture wall;

a vane stem having a neck portion, the vane stem extending through the aperture of the vane arm;

a mechanical fastener retaining a position of the vane arm in the longitudinal direction of the vane stem; and an impedance clip partially enclosing a portion of the second end of the vane arm to provide redundant position retention of the vane arm in the longitudinal direction of the vane stem, wherein the impedance clip comprises:

a first side wall;

a second side wall opposite the first side wall;

a third side wall connecting the first side wall and the second side wall;

a first top wall attached to the first side wall, the first top wall being oriented about perpendicular to the first side wall;

a second top wall is attached to the second side wall, the second top wall being oriented about perpendicular to the second side wall, wherein the first top wall and the second top wall includes a cut to wrap around the neck portion of the vane stem, and wherein the first top wall and the second top wall include a tab that bends into the aperture of the vane arm proximate the neck portion of the vane stem.

2. The vane arm assembly of claim 1, wherein the impedance clip is interposed between the mechanical fastener and the vane arm.

3. The vane arm assembly of claim 1, further comprising:

an angled face disposed on an exterior of the vane stem; and a wedge face disposed on the aperture wall, the wedge face and the angled face having a corresponding geometry, the wedge face and the angled face in contact with each other in a preloaded condition to transmit torque from the vane arm to the vane stem.

4. The vane arm assembly of claim 3, further comprising:

an anti-rotation wall disposed on the exterior of the vane stem, the anti-rotation wall angularly offset from the angled face of the vane stem; and an anti-rotation surface disposed on the aperture wall and angularly offset from the wedge face of the vane arm, the anti-rotation wall and the anti-rotation surface having a corresponding geometry, the anti-rotation wall and the anti-rotation surface in contact with each other to maintain torque transmission from the vane arm to the vane stem during a surge condition.

5. The vane arm assembly of claim 4, wherein the anti-rotation wall is disposed radially outwardly of the angled face.

6. The vane arm assembly of claim 4, wherein the anti-rotation surface is disposed radially outwardly of the wedge face.

7. The vane arm assembly of claim 1, wherein the vane arm is operatively coupled to an actuator ring with a pin proximate to a first end of the vane arm, the vane arm operatively coupled to the vane stem proximate a second end of the vane arm to actuate movement of at least one adjustable guide vane in the gas turbine engine.

8. A gas turbine engine comprising:

a compressor section;

a combustor section;

a turbine section; and a vane arm assembly operatively coupled to an actuator ring and to at least one adjustable guide vane in the compressor section, the vane arm assembly comprising:

a vane arm having a first end, a second end opposite the first end, and an aperture proximate the second end, the aperture being defined by an aperture wall;

a vane stem having a neck portion, the vane stem extending through the aperture of the vane arm;

a mechanical fastener retaining a position of the vane arm in the longitudinal direction of the vane stem; and an impedance clip partially enclosing a portion of the second end of the vane arm to provide redundant position retention of the vane arm in the longitudinal direction of the vane stem, wherein the impedance clip comprises:

a first side wall;

a second side wall opposite the first side wall;

a third side wall connecting the first side wall and the second side wall;

a first top wall attached to the first side wall, the first top wall being oriented about perpendicular to the first side wall;

a second top wall is attached to the second side wall, the second top wall being oriented about perpendicular to the second side wall, wherein the first top wall and the second top wall include a cut out to wrap around the neck portion of the vane stem, and wherein the first top wall and the second top wall include a tab that bends into the aperture of the vane arm proximate the neck portion of the vane stem.

9. The gas turbine engine of claim 8, wherein the impedance clip is interposed between the mechanical fastener and the vane arm.

10. The gas turbine engine of claim 8, wherein the vane arm assembly further comprises:

an angled face disposed on an exterior of the vane stem; and a wedge face disposed on the aperture wall, the wedge face and the angled face having a corresponding geometry, the wedge face and the angled face in contact with each other in a preloaded condition to transmit torque from the vane arm to the vane stem.

11. The gas turbine engine of claim 10, further comprising:

an anti-rotation wall disposed on the exterior of the vane stem, the anti-rotation wall angularly offset from the angled face of the vane stem; and an anti-rotation surface disposed on the aperture wall and angularly offset from the wedge face of the vane arm, the anti-rotation wall and the anti-rotation surface having a corresponding geometry, the anti-rotation wall and the anti-rotation surface in contact with each other to maintain torque transmission from the vane arm to the vane stem during a surge condition.

12. The gas turbine engine of claim 11, wherein the anti-rotation wall is disposed radially outwardly of the angled face.

13. The gas turbine engine of claim 11, wherein the anti-rotation surface is disposed radially outwardly of the wedge face.

14. The gas turbine engine of claim 8, wherein the vane arm is operatively coupled to an actuator ring with a pin proximate to a first end of the vane arm, the vane arm operatively coupled to the vane stem proximate a second end of the vane arm to actuate movement of at least one adjustable guide vane in the gas turbine engine.

* * * * *